United States Patent [19]

Ewing et al.

[11] 4,335,997

[45] Jun. 22, 1982

[54] STRESS RESISTANT HYBRID RADIAL TURBINE WHEEL

[75] Inventors: Bruce A. Ewing, Martinsville; Leonard C. Lindgren, Indianapolis, both of Ind.

[73] Assignee: General Motors Corporation, Detroit, Mich.

[21] Appl. No.: 112,446

[22] Filed: Jan. 16, 1980

[51] Int. Cl.[3] ..... F01D 5/14

[52] U.S. Cl. ..... 416/185; 416/213 R; 416/241 R; 416/244 A

[58] Field of Search ..... 416/244 A, 213 R, 241 R, 416/241 B, 223 A, 223 B

[56] References Cited

U.S. PATENT DOCUMENTS

| | | | |
|---|---|---|---|
| 2,757,901 | 8/1956 | McVeigh | 416/244 A X |
| 2,807,871 | 10/1957 | Wagner et al. | 416/213 R |
| 2,922,619 | 1/1960 | Slemmons | 416/213 R X |
| 2,941,780 | 6/1960 | Nuell et al. | 416/182 |
| 3,077,297 | 2/1963 | Clarke | 416/244 A X |
| 3,665,585 | 5/1972 | Dunn et al. | 416/241 R X |
| 3,715,176 | 2/1973 | Kerklo | 416/244 A X |
| 3,873,234 | 3/1975 | Penny | 416/241 B |
| 3,940,268 | 2/1976 | Catlin | 75/208 R |
| 4,096,615 | 6/1978 | Cross | 29/156.8 R |
| 4,152,816 | 5/1979 | Ewing et al. | 416/244 A X |
| 4,188,169 | 2/1980 | Mowill | 416/185 |
| 4,221,540 | 9/1980 | Savonuzzi | 416/214 A X |
| 4,273,512 | 6/1981 | Weiler | 416/241 R X |

FOREIGN PATENT DOCUMENTS

| | | | |
|---|---|---|---|
| 1122205 | 9/1956 | France | 416/213 |
| 770004 | 3/1957 | United Kingdom | 416/244 A |
| 1148335 | 4/1969 | United Kingdom | 416/244 A |
| 1341578 | 12/1973 | United Kingdom | 416/213 |

*Primary Examiner*—Everette A. Powell, Jr.
*Attorney, Agent, or Firm*—J. C. Evans

[57] ABSTRACT

A hybrid dual property radial turbine rotor for a gas turbine engine includes an airfoil shell having a plurality of radially outwardly directed airfoils thereon joined to a continuously circumferentially formed inner periphery including a constant diameter axially extending portion and a radially outwardly flared skirt portion thereon into which is fitted a preformed hub plug of dense stress resistant material having an axially extending nose portion thereon with a controlled constant circumference surface throughout its length of a precision dimensioned diameter and further including a conical end thereon with a surface thereon of a slope that is congruent with the slope of the flared skirt portion of the cast metal rotor shell and wherein the slope of the flared skirt portion is configured to optimize the location of the high strength hub material and to achieve optimum blade and hub stress levels.

1 Claim, 4 Drawing Figures

STRESS RESISTANT HYBRID RADIAL TURBINE WHEEL

This invention relates to hybrid turbine rotor assemblies and more particularly to hybrid radial flow type turbine engine rotors.

Gas turbine rotors used in small gas turbine engines have discs and airfoil arrays that are dimensionally configured to make it difficult to mechanically connect blades of a first metallurgical composition to a disc of a second metallurgical composition. More specifically, it is recognized that the airfoil components of a turbine wheel are subjected to higher temperature operation and are preferably of a creep resistant superalloy material; while the material of the disc should have substantial strength and ductility to withstand high stresses produced by centrifugal loads and thermal gradients.

For example, one such hybrid turbine rotor is set forth in U.S. Pat. No. 2,479,039, issued Aug. 16, 1949, to D. Cronstedt. It is made by multi-stage centrifugal casting method and applies to large turbine rotors. It is difficult to mechanically couple the turbine disc of small gas turbines by conventional joints and ocupling components to a blade array. Accordingly, in U.S. Pat. No. 3,940,268, issued Feb. 24, 1976, to John T. Catlin, a disc of powdered metal material is connected to a plurality of radially outwardly directed airfoil components by locating them in a mold and producing a metallurgical bond between the airfoil components and the disc during a hot isostatic formation of the disc or hub element. While blades can be bonded to a disc of a differing material by the method set forth in the aforesaid Catlin patent, hybrid or composite turbine rotor structures formed by such methods lack precision, dimensional control between adjacent airfoil components. Such dimensional imprecision is especially undesirable in the case of small, high speed gas turbine rotors.

In order to achieve accurate dimensional relationship between separate airfoil components in a turbine configuration, one method includes preforming blade components to exact dimensional shapes and thereafter assembling the individual blade components in a precisely shaped ring. Thereafter, the airfoil ring assembly is joined to a preformed hub of dissimilar material properties by hot isostatic pressure technology as is more specifically set forth in U.S. Pat. No. 4,152,816, issued May 8, 1979, to Ewing et al, for METHOD OF MANUFACTURING A HYBRID TURBINE ROTOR.

An object of the invention is to provide an improved turbine rotor consisting of a cast airfoil shell of super alloy temperature resistant material and a hot isostatically pressed powdered metal disc hub fit in the cast airfoil shell by bonding and configured to combine desirable high temperature resistant properties of the airfoil materials and high strength of the disc hub as it is subjected to high stresses due to centrifugal loading and differential thermal expansion between the outer portions exposed to hot gas flow therethrough and cooler running center hub portions of the rotor.

Another object of the present invention is to provide an improved hybrid or composite radial turbine rotor assembly including a hub disc and a cast airfoil shell wherein the cast airfoil shell has an inner hub rim and a cascade of radial airfoils at an exact dimensional form to maintain desired aerodynamic flow paths therethrough and including a cavity therethrough of increasing diameter at the back plate surface of the shell in which is fit a preformed near-net-shape hub disc having a conical skirt portion defining a stress resistant segment at the back of the hub and wherein the slope of the flared skirt portion is configured to optimize the location of the high strength hub material and to achieve optimum blade and hub stress levels.

Yet another object of the present invention is to provide an improved hybrid radial turbine engine rotor including a cast airfoil shell having precisely located outer aerodynamic surfaces thereon and an internal cavity therethrough having a cylindrical extent and including a flared segment of increasing diameter at a backplate of the shell and in which is fit a near-net shaped hub disc with a cylindrical nose plug and a conically formed flared backplate thereon with mating surfaces between the airfoil shell and the outer surfaces of the hub disc bonded together wherein the slope of the flared skirt portion is configured to optimize the location of the high strength hub material and to achieve optimum blade and hub stress levels.

Still another object of the invention is to provide such a dual property rotor including a forged titanium hub that is bonded to a cast titanium airfoil shell to combine desirable high temperature resistant properties of materials at the point of gas flow through the rotor and high stress resistance at the rim portion of a rotor wheel subjected to high stress levels because of centrifugal loading.

Further objects and advantages of the present invention will be apparent from the following description; reference being had to the accompanying drawings wherein a preferred embodiment of the present invention is clearly shown.

Figure 1:
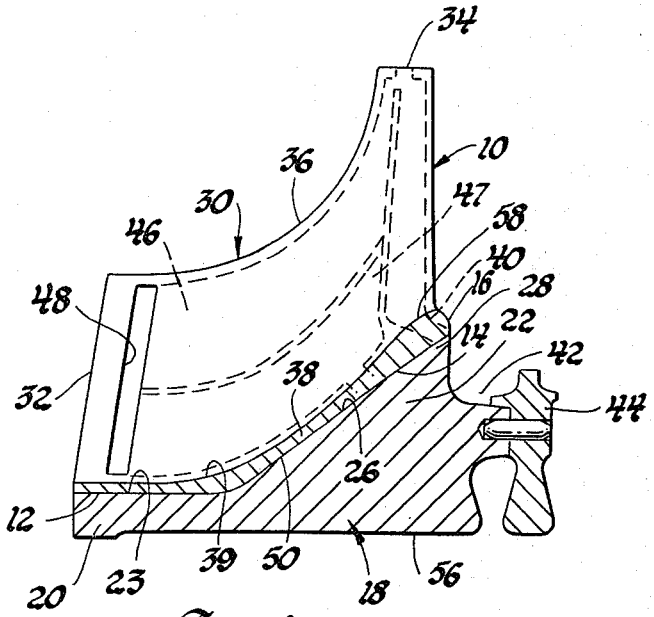
FIG. 1 is a longitudinal sectional view of a hybrid radial turbine rotor in accordance with the present invention.

The present invention, as shown in FIG. 1, includes a cast, bladed air-cooled airfoil shell 10 having a constant diameter bore 12 at one end thereof and a conical cavity 14 at the opposite end thereof having a variable diameter from the constant diameter bore 12 to a rear wall or plate segment 16 of the shell 10.

The invention further includes a powdered metal plug or hub disc 18, preferably a powdered metal preform of consolidated PA-101 composition. The hub disc 18 includes a cylindrical nose portion 20 thereon and a conical skirt 22.

The plug nose 20 has a constant diameter outer surface 23 thereon that is press fit into the constant diameter bore 12 within the cast air-cooled airfoil shell 10 and the flared conical end 22 of the hub disc 18 has a precisely machined conical surface 26 formed thereon that is congruent with the surface of the cavity 14 that is machined in the airfoil shell 10.

The shell 10 and the hub disc 18 have an interference fit formed therebetween to position a backplate segment 28 of hub disc 18 in alignment with the aft edges 29 of each of the resultant radial airfoil blades 30 on the shell 10. Each of the cast metal blades 30 includes an exducer edge 32 thereon and an inducer 34 thereon joined by a radially outwardly curved tip 36 and joined together by a radially inwardly formed hub rim 38 joining each of the cast blades 30 of the shell 10 and definining hub surfaces 39 between each of the blades 30. In the illustrated arrangement, an air cooling passage is formed in each blade including an inlet opening 40 that is in communication with a source of cooling air 42 as formed between the rotor and the associated rotary seal assembly 44. The inlet 40 is in communication with internal cavities 46, 47 in each of the blades 30 thereof for exhaust of cooling fluid through a side slot 48 formed in each of the blades immediately upstream of the exducer edge 32.

Figure 2:
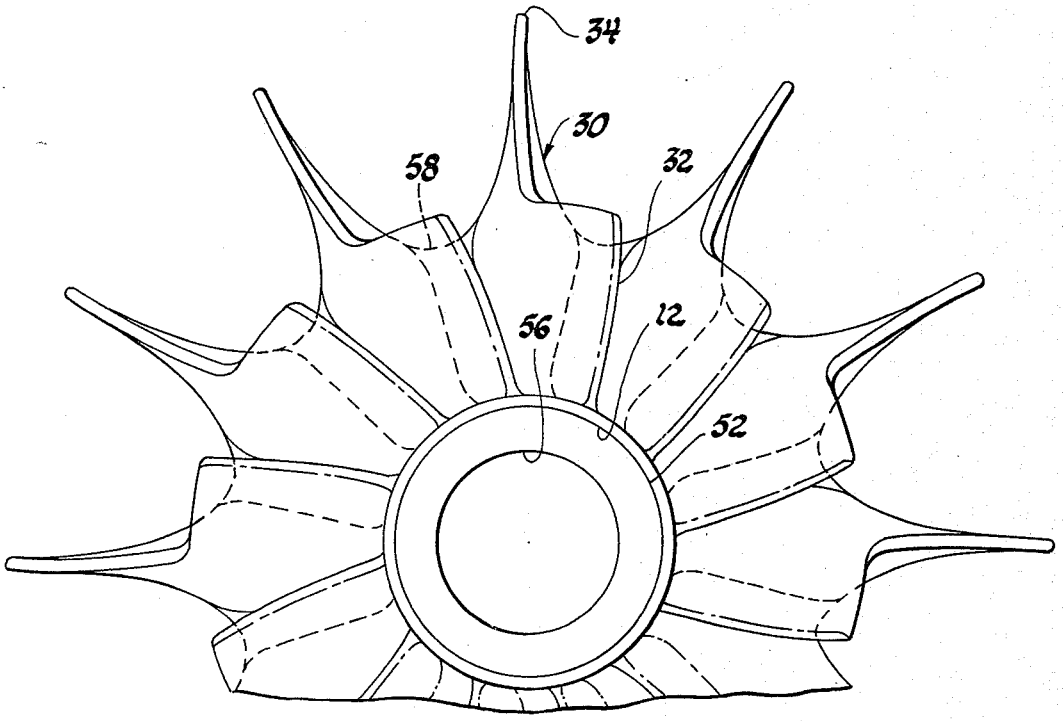
FIG. 2 is an elevational view of one end of the rotor wheel in FIG. 1 looking in the direction of arrows 2—2.

A metallurgical butt type joint 50, shown in FIG. 1, is formed between shell 10 and hub disc 18. Joint 50 has an axial annular segment 52, FIG. 2, spaced in parallel relationship to the axis of the rotor. Joint 50 also includes a conical segment 54, seen in FIG. 3, which defines a joint angle divergent from segment 52. The joint has excellent metallurgical joint integrity that is of high strength in tensile, stress rupture and low cycle fatigue testing. Microscopic evaluation of the joint 50 shows that the bond is continuous across shell 10 and disc 18.

Parent metal PA101 mechanical properties at room temperature and 1200° F. show that the backplate 28 of the hybrid turbine rotor has a strength equivalent to some of the strongest materials that are presently commercially available in rotor designs machined from forgings or integral castings.

Materials suitable for forming the cast shell are listed in the following table and material for forming the powdered metal hub disc are also listed in a following table.

| | CAST SHELL - Mar - M247, Composition | | | | | | |
|---|---|---|---|---|---|---|---|
| Alloy | C | Cr | Mo | Al | Ti | Co | W |
| Mar-M247 | 0.15 | 9.0 | 0.5 | 5.5 | 1.5 | 10.0 | 10.0 |
| (cont'd) | Hf | Zr | B | | Ta | Ni | |
| | 1.35 | 0.05 | 0.015 | | 3.1 | Bal | |

| HUB DISC - PA 101 Alloy Composition (IN 792 + Hf) | | | | | | | | | | | |
|---|---|---|---|---|---|---|---|---|---|---|---|
| C | Cr | Co | Mo | W | Ta | Ti | Al | B | Zr | Hf | Ni |
| .15 | 12.6 | 9.0 | 2.0 | 4.0 | 4.0 | 4.0 | 3.5 | .015 | .10 | 1.0 | Bal |

The hub disc 18 can be formed from a forged titanium alloy and HIP bonded to a cast Titanium alloy shell 10 to produce a centrifugal compressor wheel.

The forged titanium hub is thus a high strength wrought configuration and has its outer surface configuration similar to the previously described hub disc 18 so that it will fit into a cavity machined into the titanium airfoil shell. The wrought portion of the joint, because of its high strength capabilities, is preferentially exposed to the highly stressed areas in the backplate of the overall rotor assembly as was the backplate 28 of the powdered metal plug 18.

Performance of radial turbine rotors of the type described above is limited by stress distribution therein. The equivalent stress conditions in a rotor limit the achievable tip speeds primarily because of an excessive tangential bore stress level particularly in cases where there is a front drive power turbine shafting system that requires sizeable bore holes in a rotor such as shown at bore 56 through the hub disc 18. In order to provide required connection details and a bore diameter at the bore 56 and retain proper fatigue life and burst requirements, in accordance with the present invention, the hybrid arrangement requires wrought properties at the bore 56 in order to achieve maximum tip speeds at the airfoil blades 30 during rotor operation.

In accordance with the present invention, the angle of the resultant joint 50 at the conical surface 26 of the hub disc 18 is an optimum contour which reflects the contour of the hub surface 39. The contour is selected to achieve an optimum balance between stress levels in the blades 30 and the hub disc 18 within limits defined by aerodynamic requirements.

Figure 3:
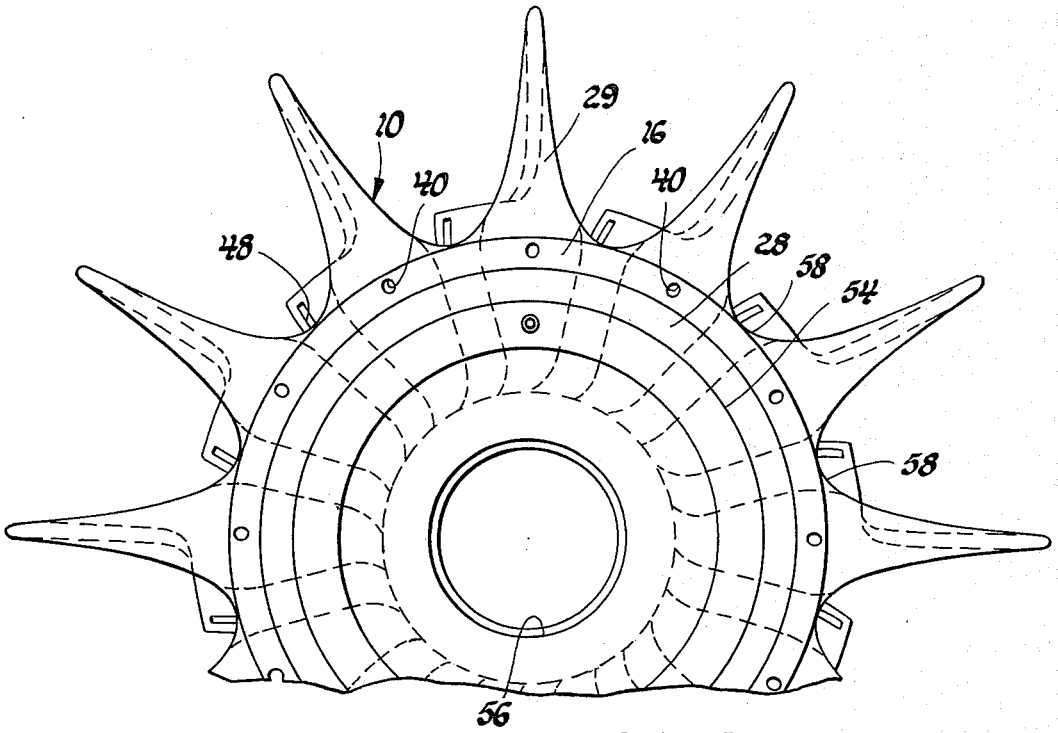
FIG. 3 is an end elevational view of the present invention from the opposite end thereof.
Figure 4:
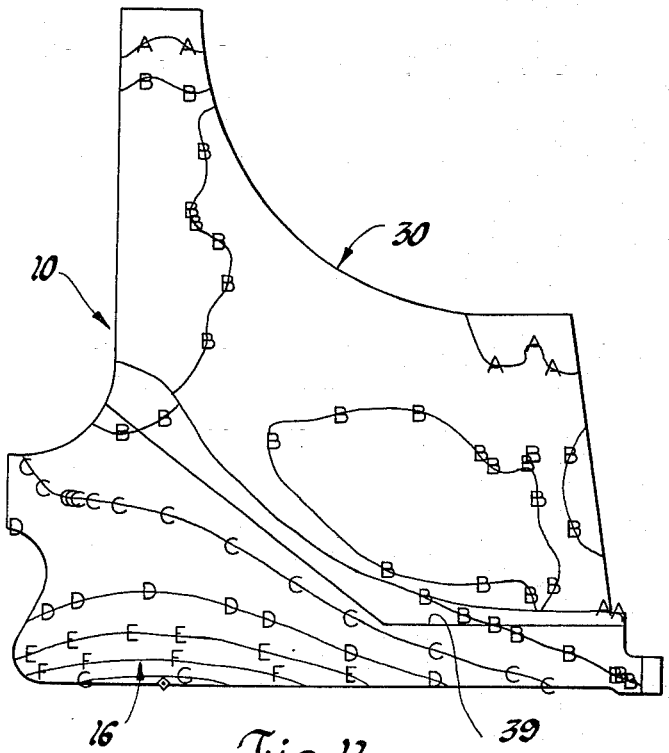
FIG. 4 is a plot of equivalent stress profiles in one embodiment of the invention.

The illustrated arrangement includes fully scalloped openings 58 between each of the blades 30 as viewed from the aft end of the rotor as shown in FIG. 3. Elimination of the backplate serves to reduce dead load on the hub disc and thus reduces disc stresses. While there is some penalty in efficiency because of the cut-off in the gas flow passage associated with the fully scalloped openings 58, the penalty is not severe since clearance losses at the vicinity of the scalloped openings 58 represent an offsetting efficiency increase because of reduction of losses due to backplate friction.

In the illustrated arrangement the radial blade taper is logarithmic. This thickness distribution provides the lowest taper ratio to achieve desired stress levels in the construction while minimizing dead load on the disc. The logarithmic blade taper eases aerodynamic design by minimizing the blade thickness and thus providing lower trailing edge blockage and lower passage velocity levels during gas flow through the rotor.

The hybrid or dual property nature of the illustrated rotor enables variable material properties to be used in the rotor that will yield greater life than a monolithic rotor of wrought design. The cast Mar-247 shell 10 has superior stress rupture properties and is a low cost method of fabrication. The inner hub disc 18 of PA 101 powdered metal material has higher strength and greater ductility and superior fatigue properties than an integrally cast wheel. The bonding of the hub disc 18 to the shell 10 enables two materials to be used in a bladed rotor without requiring a mechanical fastener detail therebetween.

The hub 38 of the illustrated rotor has an average tangential stress of 50,300 PSI and an average operating temperature of 1,203° F. The inner portion of the wheel represented by the hub disc 18 has an average tangential stress of 79,300 PSI in an average temperature of 1104° F. The higher strength, ductility and superior fatigue material of the hub disc 18 is located to traverse greater regions of higher stress than in the case of a constant diameter smaller diameter hub of the type heretofore used in hybrid rotor configurations.

In the case of centrifugal compressor designs, the utilization of investment cast titanium shells bonded to wrought titanium hubs results in a more cost effective design than would be possible if an equivalent design were to be produced by machining a monolithic forging due to the inherently superior shape making capabilities of the investment casting process used to produce the airfoil shell. By comparison to a conventional monolithic titanium casting, the hybrid rotor design would exhibit superior life at a modest cost penalty due to the inherently superior low cycle fatigue capabilities unique to the wrought hub.

While the embodiments of the present invention, as herein disclosed, constitute a preferred form, it is to be understood that other forms might be adopted.

The embodiments of the invention in which an exclusive property or privilege is claimed are defined as follows:

1. In a radial flow turbine rotor assembly of the type having a clearance bore therethrough for passage of a shaft and an equivalent stress pattern wherein a maximum equivalent stress occurs at said clearance bore and equivalent stresses decrease generally in proportion to radial outward distance from said clearance bore with equal stress levels exhibiting a generally cone-like distribution proceeding from a front portion of said rotor to a rear portion, the combination comprising, a metal hub having said clearance bore therethrough and wrought properties capable of withstanding during operation of said rotor assembly said maximum equivalent stress and including a cylindrical portion extending rearward from said front portion to an integral flared-back portion defining a frustoconical outer surface generally conforming to said cone-like distributions of levels of equal equivalent stresses, a bladed disc fabricated from a dissimilar metal incapable of withstanding said maximum equivalent stress during operation of said rotor assembly and including a plurality of radially extending blades interconnected by a central rim defining an outer surface flared back from said rotor front portion which outer surface cooperates with said blades in defining a plurality of aerodynamic gas flow passages of preselected dimensions, said disc further including a cylindrical bore corresponding in dimension to said hub cylindrical portion and a frustoconical cavity connected to said cylindrical bore corresponding in dimension to said hub flared-back portion, said disc being received on said hub so that the interface defined therebetween lies radially outboard of all of said cone-like distributions of levels of equal equivalent stresses exceeding the functional strength of said disc material, and means defining a metallurgical bond between said disc and said hub across the entire extent of said interface therebetween.

* * * * *